US006003677A

United States Patent [19]

Foley

[11] Patent Number: 6,003,677

[45] Date of Patent: Dec. 21, 1999

[54] METHOD FOR THE AUTOMATED PROCESSING OF ATM ENVELOPES

[75] Inventor: James E. Foley, Easton, Conn.

[73] Assignee: Agissar Corporation, Stratford, Conn.

[21] Appl. No.: 09/062,220

[22] Filed: Apr. 17, 1998

[51] Int. Cl.[6] ..... B03B 9/00

[52] U.S. Cl. ..... 209/2; 209/3.1; 209/3.3

[58] Field of Search ..... 209/1, 2, 3.1, 3.2, 209/3.3, 583, 587, 567, 569, 576, 586

[56] References Cited

U.S. PATENT DOCUMENTS

| | | | |
|---|---|---|---|
| 3,266,626 | 8/1966 | Simijian | 209/75 |
| 3,295,139 | 12/1966 | Simijian | 346/22 |
| 5,036,984 | 8/1991 | Labarthe | 209/3.3 |
| 5,460,273 | 10/1995 | Stevens et al. | 209/584 |
| 5,464,099 | 11/1995 | Stevens et al. | 209/3.1 |
| 5,518,121 | 5/1996 | Stevens et al. | 209/1 |

*Primary Examiner*—David H. Bollinger
*Attorney, Agent, or Firm*—St. Onge Steward Johnston & Reens LLC

[57] ABSTRACT

A method of processing groups of envelopes that have contents contained therein. The method prints information on at least one side of an envelope and then separates that side from the rest of the envelope. The contents of each envelope are then placed adjacent to the separated side and assembled in series with other separated sides and contents. When the separated sides and contents are assembled, the separated sides act as a boundary between other envelopes, thus preventing the contents of the envelopes from becoming commingled with contents from other envelopes. The printed information on the separated side of the envelope provides an audit trail for subsequent processing.

22 Claims, 3 Drawing Sheets

METHOD FOR THE AUTOMATED PROCESSING OF ATM ENVELOPES

FIELD OF THE INVENTION

The present invention relates to envelope processing, and more specifically to processing envelopes with contents therein that originate from an automatic teller machine (ATM).

BACKGROUND OF THE INVENTION

In the field of automatic teller machines such as those found at banks, deposits are often made using a standard envelope. The envelope can contain a single check for deposit, multiple checks for deposit, deposit slips, cash currency, letters to the bank and a wide variety of printed and other matter. When a deposit envelope is inserted into an ATM, the ATM usually prints on the envelope a transaction number, the ATM's identification number, the receipt time and date, as well as account information. Afterwards, the envelope is directed to a bin where hundreds of transactions are stored. The envelopes are then subsequently bagged and brought to a processing station.

In traditional bulk mail processing, large quantities of envelopes can be processed using automated means, as exemplified in Stevens U.S. Pat. Nos. 5,518,121, 5,464,099, 5,460,273, Simjian U.S. Pat. Nos. 3,295,139, and 3,266,626. These automated means are capable of, among others, opening the envelopes, extracting their contents and then arranging the contents for further processing. However, due to the extremely wide variety of materials that can be placed in ATM deposit envelopes, the aforementioned automated means are not efficient. In addition, the aforementioned means are not well suited where it would be preferable to trace ATM envelope contents back to the ATM machine where it was deposited. This is because they do not include means for keeping an identification number or numbers with the contents of the envelopes as they are moved along the processing stream. Tracing ATM envelope contents would be extremely important in bank transactions that are monitored by the Federal and State government, which must meet certain standards. Therefore, ATM envelope processing has mostly been accomplished by hand and not by automated means, thereby increasing the cost associated with such processing.

What is desired therefore is an efficient automated method for processing ATM envelopes that can reduce labor expense and increase audit control.

SUMMARY OF THE INVENTION

Accordingly, an object of the invention is to provide a method for processing envelopes.

Another object is to provide a method for processing ATM envelopes that can contain a wide variety of materials therein.

A further object is to provide a method for processing ATM envelops that associates the contents of the envelope with the transaction.

A further object is to provide a separator between other envelope's contents.

Still a further object is to provide an audit trail which allows for the tracking of the envelope's contents through subsequent processing steps.

Yet another object is to provide a method for processing ATM envelopes that can trace envelope contents back to the ATM machine that it was deposited in to meet Federal and State standards.

These and other objects are achieved in accordance with the present invention by providing a method of processing groups of envelopes that have contents contained therein. The method prints information on at least one side of an envelope and then separates that side from the rest of the envelope. The contents of each envelope are then placed adjacent to the separated side and assembled in series with other separated sides and contents. When the separated sides and contents are assembled, the separated sides act as a boundary between other envelopes, thus preventing the contents of the envelopes from becoming commingled with contents from other envelopes. The printed information on the separated side of the envelope provides an audit trail for subsequent processing.

Other objects and advantages will become more readily apparent in view of the following detailed description when taken in conjunction with the accompanying drawings.

DETAILED DESCRIPTION OF THE INVENTION

Figure 1:
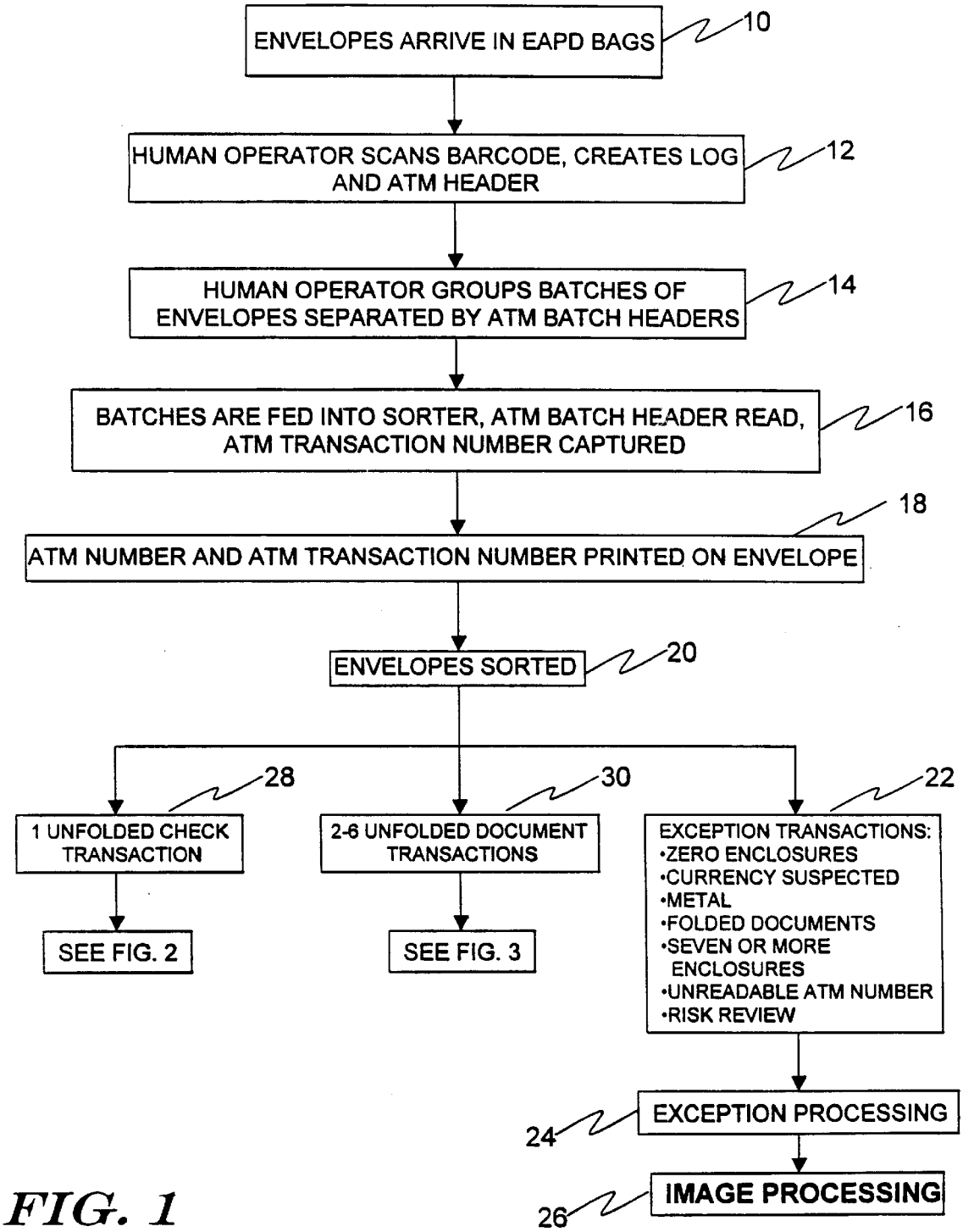
FIG. 1 is a flow diagram describing the method for processing groups of envelopes with contents contained therein.

Now referring to FIG. 1, ATM envelopes with contents therein arrive at a processing station in EAPD courier bags (10), which are lockable weatherproof bags that meet the American Banker's Association standards. Hereinafter, the term "batch" will be used to describe all of the ATM envelopes associated with a single EAPD bag. Although ATM envelopes are depicted in this description it is not intended to limit the scope of the invention and it should be understood that the process described herein can be used on any type of envelope. Each of the EAPD bags has a barcode on it that represents what ATM machine the bag came from, and substantially all of the envelopes in each bag should have an ATM transaction number on printed on either side. Usually the cause for an ATM transaction number not being printed on an envelope is due to ATM malfunctions, such as the printing mechanism on the ATM running out of ink. Next, a human operator scans the barcode from the EAPD bags to log the receipt of the bag at the processing station and to create an ATM batch header, which is a piece of paper with machine readable code on it, wherein the ATM batch header will later be used to identify batches of envelopes (12). Preferably, the human operator will use a PC-based wand bar code reader with an associated laser printer to generate the log and the ATM batch header. After this, a human operator groups the batches of envelopes (14), separating each separate batch by an ATM batch header, which was previously created. The human operator at this point also ensures that the envelopes are all orientated face first, regardless of which side of the envelope the ATM transaction identification number is printed. This is so that when information is printed on the envelope later in the process, all of that information will be on the front panel. The U.S. Postal Office uses an automated machine that orientates envelopes face first. The front side of the envelope is desirable due to its lack of construction seams.

Next, the batches of envelopes are fed into a sorter with an ATM batch header at the beginning of each batch. The sorter first reads the ATM batch header and then subsequently captures the ATM transaction number from each individual envelope by using optical character recognition (OCR), image character recognition (ICR) or other readers. The ATM transaction number may be on either side of the envelope depending on how it was inserted into the ATM machine at the time of deposit (16). After this, the sorter prints the ATM number (which was read from the ATM header) and the ATM transaction number on the front side of each of the envelopes with an ink jet sprayer (18). Preferably, the ATM number and the ATM transaction number are printed in both machine-readable format, in the form of a bar code, and human-readable format, in the form of alphanumerics. By printing the aforementioned information in both machine and human readable format, it facilitates later processing where it may be necessary for a human operator to read the printed information without using a bar-code reader or other reading device. In addition, an envelope identification number may also be printed on the front of the envelope in machine and human readable format. The printed information on the envelopes just described will also be referred to hereafter as the "audit trail information."

After the audit trail information is printed on the envelopes, the envelopes are sorted into one of a number of pockets by conventional sort criteria (20). Conventional sort criteria is determined using a currency detection, length detection, thickness detection, metal detection, micr detection (which is used for both check detection and orientation detection). Special sort criteria are used when the audit trail information dictates that the envelopes should be processed under risk review, have payment designation and/or have currency content. Items requiring risk review may include a specific account that repeatedly does not include proper payment, or a deposit over a certain amount. Envelopes with special sort criteria are processed according to Exception processing described below. In addition, envelopes that have zero enclosures, currency presence suspicion, metal (coins, clips, or staples), folded contents, seven enclosures or more, unreadable ATM headers or require manual opening and contents extraction due to a non-standard envelope or damaged envelope condition are also sent to exception processing.

It should be noted at this point that sometimes the ATM envelopes may not have an ATM transaction number printed at the time of deposit, or that number may be unreadable due to errors in the ATM machine. When this happens, it becomes impossible for the sorting process to capture the ATM transaction number and subsequently print it on the envelope in machine and human readable format. To deal with this problem, the envelopes are printed with the ATM number, which was taken from the ATM header and can then be processed in two ways. First, the envelopes may be manually examined under exception processing which is described below. However, the second and more recommended method is to sort the envelopes according to the normal sort criteria, and any exceptions that remain are handled later in the processing.

Documents designated as exception transactions (22) will be sent to exception processing (24) where human operators will replace damaged and non-standard envelopes with a replacement document that contains any necessary information, such as the ATM number, ATM transaction number, deposit amount, etc. When this is done, the contents and the replacement document are ready for image processing (26). Currency is replaced with cash tickets and the transactions are prepared for image processing (26). Envelopes with payment designation are removed from the process and are processed in a manner depending on the payment designation. The associated ATM transaction number is then logged for ATM reconciliation. If the envelopes are designated as risk review, they are physically prepared for image processing (26). Furthermore, any other problems associated with the envelopes or contents are accordingly corrected at this point and then sent to image processing (26).

Figure 2:
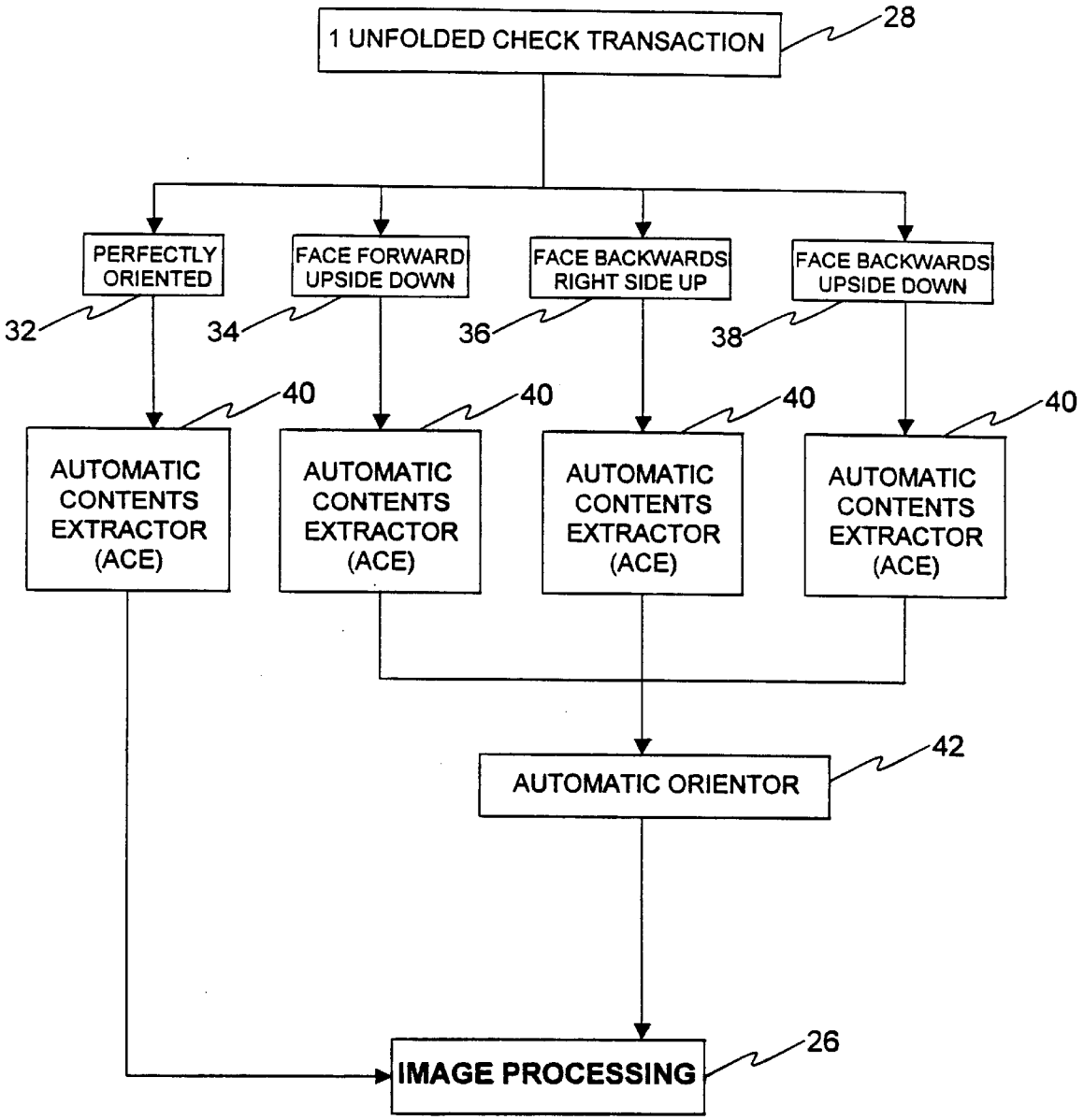
FIG. 2 is an extension to FIG. 1, which details the method employed when an envelope is designated as having I unfolded check transaction.

Envelopes that are not designated for exception processing after the initial sorting will be designated as either one unfolded check transaction (28), or two to six unfolded document transactions (30). Now referring to FIG. 2, of those envelopes that are designated as one unfolded check transaction (28), they will be further designated as having the check being perfectly oriented (32), face forward and upside down (34), face backwards and right side up (36), or face backwards and upside down (38), the latter three being "incorrectly oriented." The envelopes designated as being perfectly oriented (32) will be sent to the automatic contents extractor (ACE) (40) that cuts envelopes on all four sides. An example of an apparatus that cuts envelopes on four sides can be found in U.S. Pat. No. 3,295,139. The ACE cuts each envelope on all four sides, retains the front side that has the ATM number and the ATM transaction number printed on it, and discards the back side. The front side is then placed adjacent to the contents that it is associated with and is stacked for image processing (26). It should be noted that when the stacking occurs, the front sides of each respective envelope act as separators between envelope contents. Preferably, the ACE will have a redundant check on thickness prior to extraction, as well as after extraction. In addition, the ACE will preferably have a redundant check on the ATM number prior to extraction and will stop the automatic extraction if there is an absence of the ATM number, poor printing of the ATM number, or an unfamiliar ATM number. After the perfectly orientated checks are extracted and stacked, they are sent to image processing (26). The image processing (26) will not be described here since it is beyond the scope of the present invention.

The envelopes being designated as having one unfolded check (28) and incorrect orientation (34, 36 and 38) will be sent to the ACE, as described above, and subsequently sent to an automatic orientor (42), such as the Aggisar Corporation Model APO (Automatic Payment Orientor), which will then process the checks so as to have perfect orientation, which is face forward and right side up. After the checks have been perfectly orientated, they will be stacked (with the front sides of the envelopes acting as separators for their respective contents) and then sent to image processing (26). It should be understood that multiple ACE and auto orientation machines are preferably used to facilitate the process described herein and that single ACE and automatic orientors are shown here for illustrative purposes. The number of ACE and automatic orientors will vary depending on the volume of processing to be accomplished.

Figure 3:
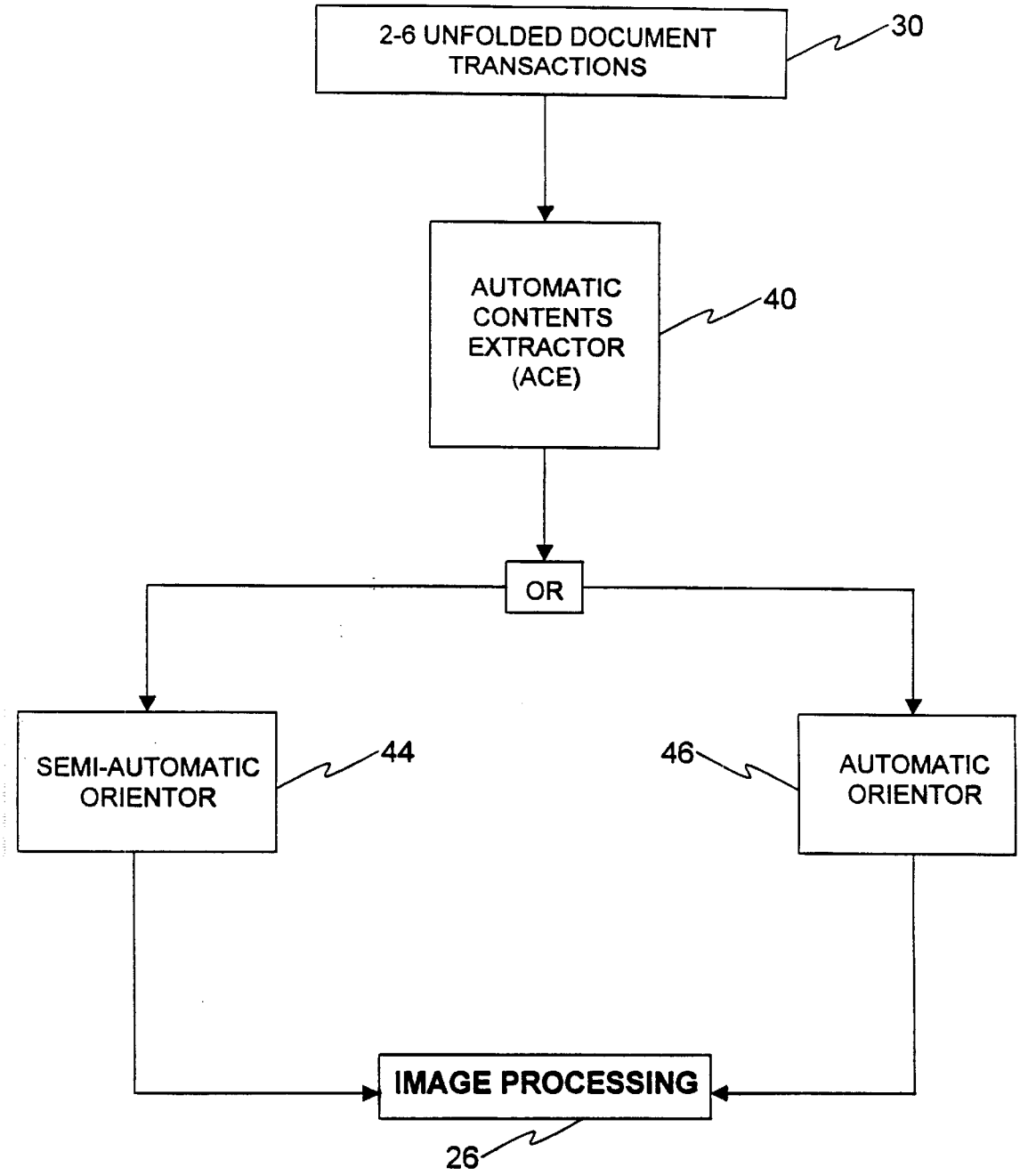
FIG. 3 is an extension of FIG. 1, which details the method employed when an envelope is designated as having 2–6 unfolded document transactions.

Now referring to FIG. 3, the envelopes coming out of the initial sorting process that have been designated as two to six unfolded documents (30) will be sent to the ACE (40) as described above, which will extract the contents and place the front of the envelope adjacent to the envelope's associated contents. The extracted contents and the front of the envelope can then be sent to a semi-automatic orientor (44)

such as the Agissar Corporation PAV (Payment Amount Verifier), and then to image processing (26). The Agissar PAV allows the operator to scan the documents for orientation and manually change a document's orientation if necessary. The semi-automatic orientation can also be done manually by hand. Alternatively, the extracted contents and the front of the envelope can be sent to an automatic orientor (46), such as the Agissar APO (Automatic Payment Orientor), which is equipped to determine: (1) what type of documents the contents comprise, i.e., check, payment stub, deposit slip, envelope panel, etc; (2) if a document is a check, whether it is correctly oriented; (3) if a document is not a check, whether it requires orientation or can be stacked in its current situation for later outsourcing on a payment processor; and (4) whether a document should be outsorted now to the orientor. Thus, after the documents in the envelopes exit the automatic orientor they will be correctly oriented and prepared for image processing (26). The preferred type of orientor, either automatic or semi-automatic, will depend on the size of the site using the orientor and the cost per transaction. For a small site, it may be most economical per transaction to use a semi-automatic orientor. For a larger site, it may be most economical to use the automatic orientor.

It should be appreciated that with either the semi-automatic orientor (44) or the automatic orientor (46), when the contents are stacked for image processing, the envelope panel (containing the printed audit trail information) associated with the contents will act a separator between other envelope contents. It should further be appreciated that for the entire process described herein the front side of the envelope is placed with its respective contents substantially all of the time to act as a separator and to provide audit information. If the front panel of the envelope cannot be used, it will be replaced with a document containing the audit trail information under exception processing.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set below.

What is claimed is:

1. A method of processing groups of envelopes having contents contained therein, each envelope having a front side and a back side, said method comprising:

printing information on at least one side of said envelope;

separating said one side from each said envelope;

for each envelope, placing said contents adjacent to said one side; and assembling in series said contents and said content's adjacent one side of each envelope to form a group of envelope contents separated by said adjacent one sides.

2. A method in accordance with claim 1 wherein said printing information comprises printing a transaction number.

3. A method in accordance with claim 2 wherein said printing a transaction number comprises printing an ATM transaction number.

4. A method in accordance with claim 2 wherein said printing information further comprises printing a header number that identifies where said envelopes originated, wherein said header number is identical for all envelopes from a same origin.

5. A method in accordance with claim 4 wherein said printing a header number comprises printing an ATM header number that corresponds to what ATM machine said envelopes originated from.

6. A method in accordance with claim 1 wherein said printing information comprises printing information in a machine-readable format.

7. A method in accordance with claim 1 wherein said printing information comprises printing information in a human-readable format.

8. A method in accordance with claim 1 wherein said printing information comprises printing information in both machine-readable format and human-readable format.

9. A method of extracting contents from envelopes as in claim 1, further comprising:

sorting said envelopes into categories according to predetermined parameters; and capturing a number from said envelope wherein said number is used when printing said information on said envelopes.

10. A method in accordance with claim 9 wherein said predetermined parameters include envelope thickness, envelope length, envelope content orientation and magnetic content.

11. A method of extracting contents from envelopes as in claim 9 wherein said capturing a number comprises capturing an ATM transaction number printed on said envelope when said envelope was deposited in an ATM machine.

12. A method of extracting contents in accordance with claim 1, further comprising orientating said contents.

13. A method of extracting contents in accordance with claim 1 wherein said placing and said assembling occurs substantially all of the time.

14. A method in accordance with claim 1 wherein said one side is said front side.

15. A method of processing groups of ATM envelopes having contents contained therein, each envelope having a front side and a back side, the method comprising:

creating an ATM batch header, said batch header comprising an identifier of where a batch of ATM envelopes originated; capturing said batch header;

capturing an ATM transaction identification number from each envelope in said batch of envelopes, said transaction number having been printed on each envelope upon deposit in an ATM machine;

printing said batch header and said transaction number on one side of each envelope wherein said batch header is identical for all envelopes in said batch, and wherein said transaction number is different for all envelopes;

sorting said batch of envelopes according to predetermined parameters;

separating said one side from each said envelope;

for each envelope, placing said contents adjacent to said one side; and assembling in series said contents and said content's adjacent one side of each envelope to form a group of envelope contents separated by said adjacent one sides.

16. A method in accordance with claim 15 wherein said printing comprises printing in a machine-readable form.

17. A method in accordance with claim 15 wherein said printing comprises printing in a human-readable form.

18. A method in accordance with claim 15 wherein said printing comprises printing in both a machine-readable form and a human-readable form.

19. A method in accordance with claim 15 wherein said placing and said assembling occurs substantially all of the time.

20. A method in accordance with claim 15 wherein said predetermined parameters include envelope thickness, envelope length, envelope content orientation and magnetic content of said envelopes.

21. A method in accordance with claim 15 wherein said one side is said front side.

22. A method in accordance with claim 15 wherein said method further comprises orientating said contents.

* * * * *